US008172349B2

(12) United States Patent
Maruyama

(10) Patent No.: US 8,172,349 B2
(45) Date of Patent: May 8, 2012

(54) FLUID DISCHARGE DEVICE, CONTROL METHOD FOR A FLUID DISCHARGE DEVICE, AND A FLUID TANK

(75) Inventor: Akihiko Maruyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 409 days.

(21) Appl. No.: 12/484,402

(22) Filed: Jun. 15, 2009

(65) Prior Publication Data

US 2009/0315928 A1 Dec. 24, 2009

(30) Foreign Application Priority Data

Jun. 13, 2008 (JP) ..... 2008-155290
Jun. 3, 2009 (JP) ..... 2009-133781

(51) Int. Cl.
*B41J 2/195* (2006.01)

(52) U.S. Cl. ..... 347/7

(58) Field of Classification Search ..... 347/5, 7, 347/86

See application file for complete search history.

(56) References Cited

U.S. PATENT DOCUMENTS

| | | | | |
|---|---|---|---|---|
| 5,049,898 | A * | 9/1991 | Arthur et al. | 347/19 |
| 6,024,440 | A * | 2/2000 | Murthy et al. | 347/65 |
| 6,062,667 | A * | 5/2000 | Matsui et al. | 347/19 |
| 6,170,939 | B1 * | 1/2001 | Ujita et al. | 347/86 |
| 6,714,744 | B2 | 3/2004 | Arima | |
| 2002/0113120 | A1 * | 8/2002 | Yajima | 235/375 |
| 2003/0202036 | A1 * | 10/2003 | Fujimoto et al. | 347/33 |
| 2004/0012645 | A1 | 1/2004 | Kinalski et al. | |
| 2005/0219336 | A1 | 10/2005 | Hayasaki et al. | |

FOREIGN PATENT DOCUMENTS

| | | |
|---|---|---|
| EP | 0985537 A1 | 3/2000 |
| EP | 2055488 A1 | 5/2009 |
| JP | 6-320732 | 11/1994 |
| JP | 7-205419 | 8/1995 |
| JP | 7-227971 | 8/1995 |
| JP | 11-126008 | 5/1999 |
| JP | 2001-246822 | 9/2001 |
| JP | 2001-253148 | 9/2001 |
| JP | 2003-011469 | 1/2003 |

OTHER PUBLICATIONS

European Search Report, Application No. EP 09007616, Mailed Sep. 21, 2009.

* cited by examiner

*Primary Examiner* — Stephen Meier
*Assistant Examiner* — Tracey McMillion
(74) *Attorney, Agent, or Firm* — Nutter McClennen & Fish LLP; John J. Penny, Jr.; Derek P. Roller

(57) ABSTRACT

A fluid discharge device, a control method for a fluid discharge device, and an ink tank enable easy and accurate confirmation of the fluid usage history, such as how much fluid is left in the tank, on the user or device side without increasing the price. An inkjet printer that discharges ink from the inkjet head to print on recording paper has a cartridge loading unit in which a ink cartridge is loaded, an inkjet head that discharges ink drawn from the ink cartridge, a reader/writer that reads and writes an ink usage history about usage of ink in the ink cartridge to an IC chip substrate disposed to the ink cartridge, and a control unit that prints at least a part of the ink usage history written to the IC chip substrate to a printable part on the outside surface of the ink cartridge by the inkjet head.

17 Claims, 6 Drawing Sheets

FLUID DISCHARGE DEVICE, CONTROL METHOD FOR A FLUID DISCHARGE DEVICE, AND A FLUID TANK

Priority is claimed under 35 U.S.C. §119 to Japanese Patent Applications No. 2008-155290 filed on Jun. 13, 2008, and No. 2009-133781 filed on Jun. 3, 2009, the disclosures of which, including the specification, drawings and claims, are incorporated herein by reference in their entireties.

BACKGROUND OF THE INVENTION

1. Field of Invention

The present invention relates to a fluid discharge device that supplies fluid from a removable fluid tank to a head from which fluid is discharged, a control method for the fluid discharge device, and a fluid tank.

2. Description of Related Art

A common type of fluid discharge device is an inkjet printer that supplies ink from a removable ink cartridge to a recording head, and discharges the ink from the recording head to print on paper.

When the ink is consumed by printing and an empty cartridge or no-ink state is detected by a sensor in this type of printer, a trademark logo is overwritten by a writing device or a single black line is added to a number-of-uses label before the ink cartridge is removed from the ink cartridge holder so that the ink cartridge cannot be used until a new replacement label is applied over the logo, and the ink cartridge is prevented from being reused again after the number-of-uses label is completely filled in when the ink cartridge has been refilled the maximum number of times. See, for example, Japanese Unexamined Patent Appl. Pub. JP-A-2003-11469.

This device enables confirmation from the label on the removed ink cartridge of whether or not the ink cartridge can be used, but because a reading sensor and a writing device are needed to read and write information on the trademark logo or the number-of-uses label, the parts count increases and the construction becomes more complicated, which leads to a higher product cost.

In addition, when the label becomes soiled or smudged with ink, the ink information cannot be read accurately by the reading sensor, and the printing process may be needlessly interrupted.

Furthermore, while whether there is ink in the cartridge and whether the ink cartridge can be used can be confirmed from the trademark logo or the number of uses label, how much ink is left cannot be accurately determined.

It is also conceivable to provide a small transparent window on the container part of the ink cartridge to enable a visual confirmation of how much ink is left or detection of whether ink is left using an optical sensor, but this requires that part of the ink storage pack inside the ink cartridge also be transparent, resulting in greater structural complexity. Furthermore, because the gas barrier performance of the materials used to form the transparent container or pack is poor, and ambient light incident to the ink can easily cause the color to change, the ink storage performance of such transparent materials is not good.

It is also conceivable to dispose an IC chip in the ink cartridge so that ink information can be written and read from the IC chip, but how much ink is left in the ink cartridge cannot be confirmed when the ink cartridge is removed from the printer. As a result, if multiple ink cartridges become mixed together, each ink cartridge must be loaded into the printer in order to confirm how much ink is left in each cartridge, and this is obviously tedious and time-consuming.

In such situations it is common for the user to shake the ink cartridge or guess how much ink is left based on the weight, but accurately determining how much ink is left is difficult with such methods. There is also little change in weight with ink cartridges that internally recover the ink used to clean the print head as waste ink, making it particularly difficult to determine how much usable ink is left based on weight.

SUMMARY OF THE INVENTION

A fluid discharge device, a control method for a fluid discharge device, and an ink tank according to at least one embodiment of the present invention are provided to enable easy and accurate confirmation of the fluid usage history, such as how much fluid is left in the tank, on the user or device side without increasing the price.

A first aspect of at least one embodiment of the invention is a fluid discharge device that has a loading unit to which a fluid tank storing a fluid is loaded and unloaded; a head that discharges fluid supplied from the fluid tank loaded in the loading unit; a reading/writing unit that reads and writes fluid usage history information relating to the use of fluid in the fluid tank to a storage unit disposed to the fluid tank; and a controller that records at least a part of the fluid usage history information written to the storage unit on an outside surface of the fluid tank housing by the head.

The fluid discharge device according to at least one embodiment of the present invention can both store the fluid usage history of fluid in the fluid tank to a storage unit and record the fluid usage history information on an outside surface of the fluid tank by the head. As a result, the user can easily and visually confirm the fluid usage history information, such as how much fluid is left, from the fluid tank after the fluid tank has been removed from the loading unit. In addition, when the fluid tank is reloaded into the loading unit, the fluid usage history information can be acquired by reading the fluid usage history information stored in the storage unit using the reading/writing unit.

As a result, even if multiple fluid tanks are mixed together, the remaining fluid quantity in each fluid tank can be visually confirmed without loading each fluid tank into the loading unit and reading the ink information from the storage unit, and mistakenly switching new and old fluid tanks when replacing the fluid tank can be eliminated.

In addition, the fluid tank container and internal fluid packs do not need to be transparent, and fluid deterioration resulting from using transparent materials is prevented.

In the fluid discharge device according to another aspect of at least one embodiment of the invention, the fluid tank loaded in the loading unit preferably has on a side facing the head a label that can be printed by the head, thereby enabling reusing the housing of the fluid tank by simply peeling the label off and applying a new label.

In the fluid discharge device according to another aspect of at least one embodiment of the invention, the controller preferably records the fluid usage history information on the fluid tank synchronized to the write timing of the fluid usage history information to the storage unit.

Because the controller of the fluid discharge device according to this aspect of the invention records the fluid usage history information on the fluid tank synchronized to the write timing of the fluid usage history information to the storage unit, the fluid usage history information written in the storage unit and the fluid usage history information recorded on the outside of the fluid tank housing match.

In the fluid discharge device according to another aspect of at least one embodiment of the invention a part of the outside surface of the housing of the fluid tank loaded in the loading unit is disposed flush to the discharge surface of the medium to which the head discharges fluid.

Furthermore, because part of the outside of the housing of the fluid tank loaded in the loading unit is disposed flush to the discharge surface to which the head discharges fluid, the fluid usage history information can be easily recorded on the outside of the fluid tank housing by the head by moving the head from the area for discharging fluid to the medium to the fluid tank side.

Another aspect of at least one embodiment of the invention provides a control method for a fluid discharge device having a loading unit to which a fluid tank storing a fluid is loaded and unloaded, a head that discharges fluid supplied from the fluid tank loaded in the loading unit, and a reading/writing unit that reads and writes fluid usage history information relating to the use of fluid in the fluid tank to a storage unit disposed to the fluid tank, the control method having a step of recording at least a part of the fluid usage history information written to the storage unit on an outside surface of the housing of the fluid tank by the head.

Because the control method for a fluid discharge device according to this aspect of the invention stores the fluid usage history of fluid in the fluid tank to a storage unit and records the fluid usage history information on an outside surface of the fluid tank housing by the head, the user can easily and visually confirm the fluid usage history information, such as how much fluid is left, from the fluid tank after the fluid tank has been removed from the loading unit. In addition, when the fluid tank is reloaded into the loading unit, the fluid usage history information can be acquired by reading the fluid usage history information stored in the storage unit using the reading/writing unit.

As a result, even if multiple fluid tanks become mixed together, the remaining fluid quantity in each fluid tank can be visually confirmed without loading each fluid tank into the loading unit and reading the ink information from the storage unit, and mistakenly switching new and old fluid tanks when replacing the fluid tank can be eliminated.

In addition, the fluid tank container and internal fluid packs do not need to be transparent, and fluid deterioration resulting from using transparent materials is prevented.

The control method for a fluid discharge device according to another aspect of at least one embodiment of the invention preferably records the fluid usage history information on the fluid tank at a time synchronized to the write timing of the fluid usage history information to the storage unit.

Because the controller of the fluid discharge device according to this aspect of the invention records the fluid usage history information on the fluid tank at a time synchronized to the write timing of the fluid usage history information to the storage unit, the fluid usage history information written in the storage unit and the fluid usage history information recorded on the outside of the fluid tank housing match.

Another aspect of at least one embodiment of the invention is a fluid tank that has fluid inside and is suitable for use in the fluid discharge device, the fluid tank having a protruding part that protrudes from a part of the fluid tank housing, and a printable unit that can be printed on the distal surface of the protruding part.

Because the printable part of the fluid tank according to this aspect of the invention protrudes, the information printed in the printable part is easy to read and the information is easy to confirm. In addition, even if the fluid tank is placed to rest on the printable part, stability is poor and the fluid tank easily tips over because this surface is stepped and not flat, and the fluid tank is therefore unlikely to be placed on the protruding surface. Furthermore, even if the fluid tank is placed resting on the printable part side, the stepped shape tilts the fluid tank and the chance of the fluid tank resting on the protruding unit is even less. Dust, particulate, and other foreign matter will therefore not stick to the printable part when set down and the quality of printing to the printable area will not diminish.

Furthermore, if the printable part can be printed on using the fluid, there is no need to provide a special fluid for printing to the printable part.

Yet further preferably, a storage unit that stores data used for detecting a remaining fluid amount is disposed to a position on the housing away from the printable part, thus reducing contamination from printing and thus reducing read/write errors.

Yet further preferably, the storage unit is disposed on the surface from which the protruding part protrudes so that if the fluid tank is placed with the printable part side down, the protruding part will prevent the surface on which the storage unit is disposed from contacting the surface on which the fluid tank rests.

Yet further preferably, the fluid tank has a substantially rectangular box shape, and the protruding part is disposed on a surface with the least area. This configuration further reduces the possibility of contact with the surface on which the fluid tank is placed.

Other objects and attainments together with a fuller understanding of the invention will become apparent and appreciated by referring to the following description and claims taken in conjunction with the accompanying drawings.

DESCRIPTION OF PREFERRED EMBODIMENTS

A fluid discharge device and a control method for a fluid discharge device according to a preferred embodiment of the invention are described below with reference to the accompanying figures.

Figure 1:
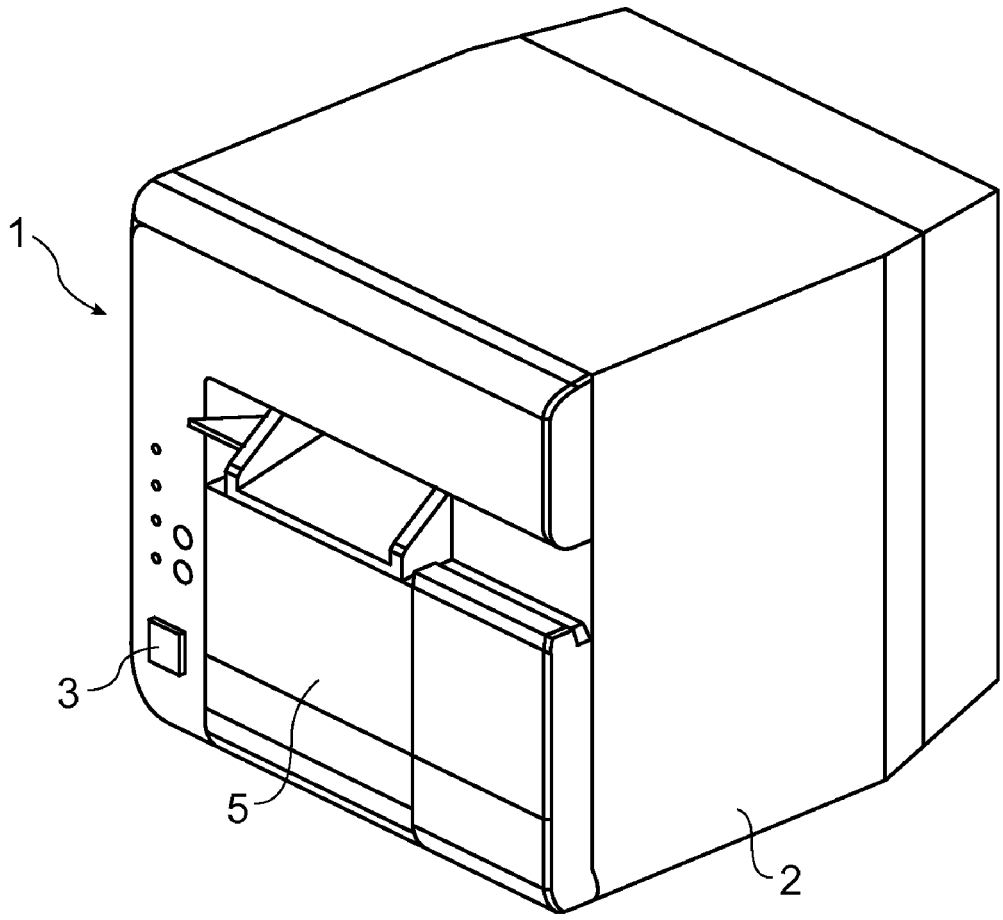
FIG. 1 is an oblique view showing the external appearance of the inkjet printer.
Figure 2:
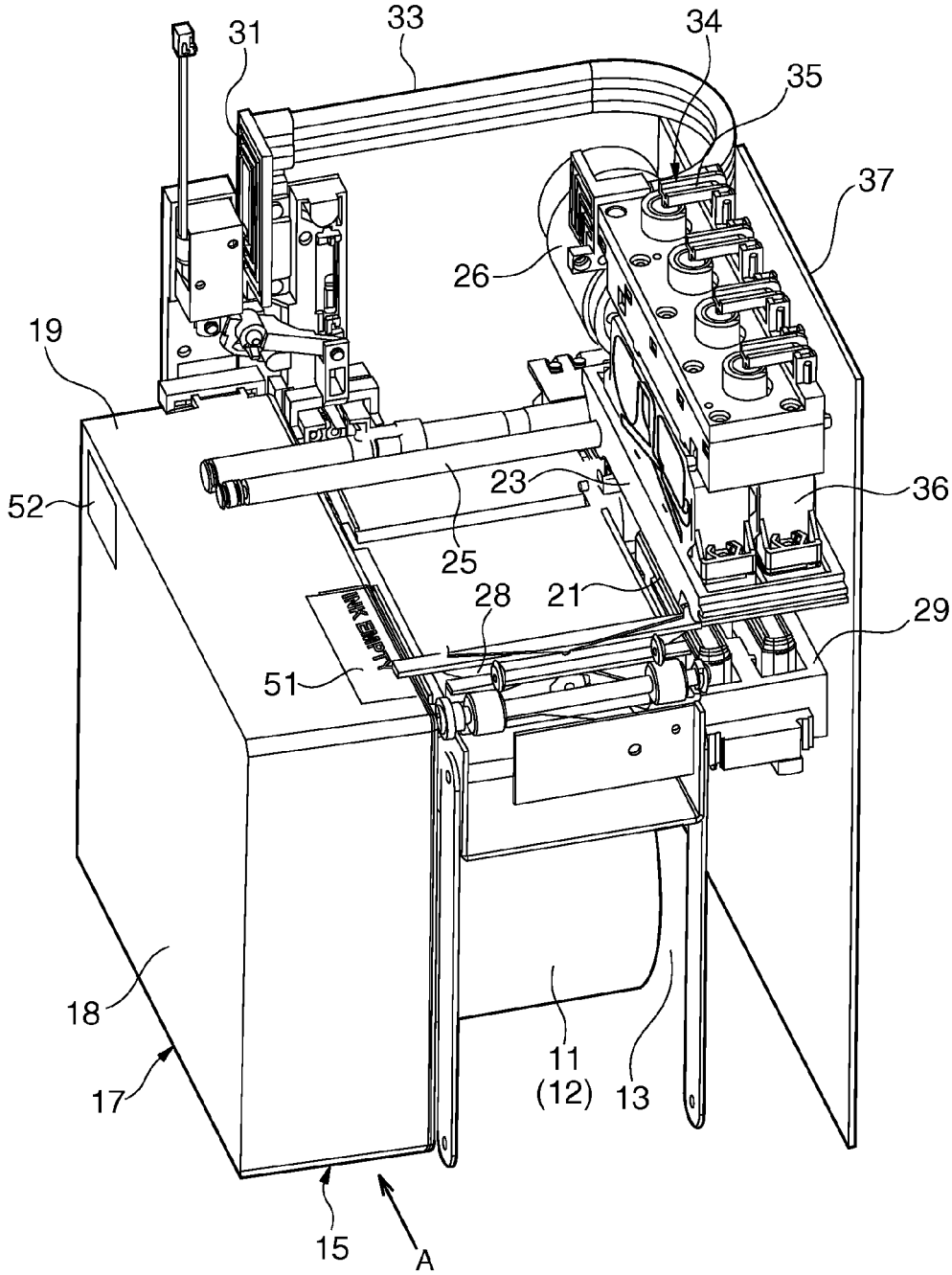
FIG. 2 is an oblique view showing the inkjet printer with the printer case removed.
Figure 3:
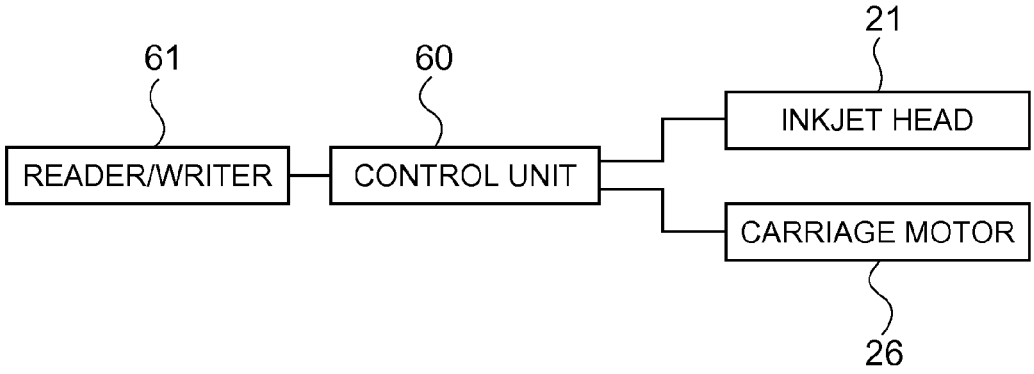
FIG. 3 is a block diagram describing the control system of the inkjet printer.
Figure 4:
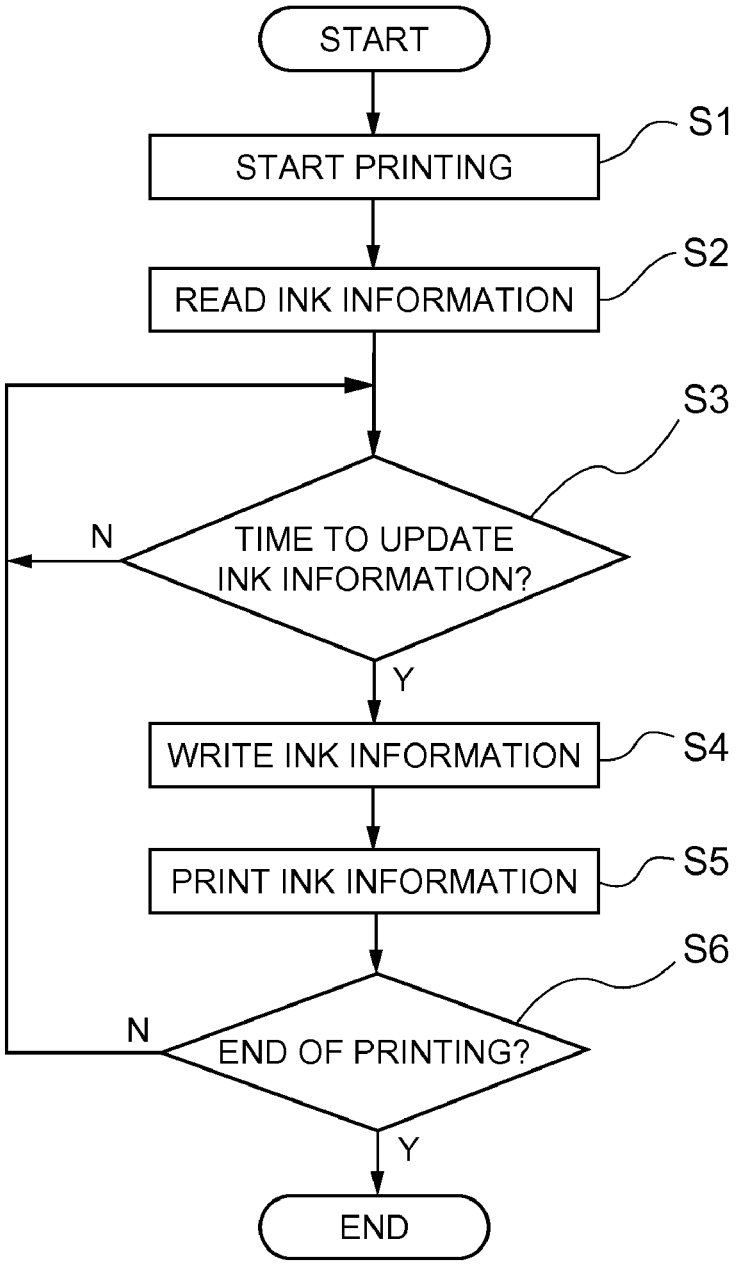
FIG. 4 is a flow chart describing the flow of control by the control unit.
Figure 5:
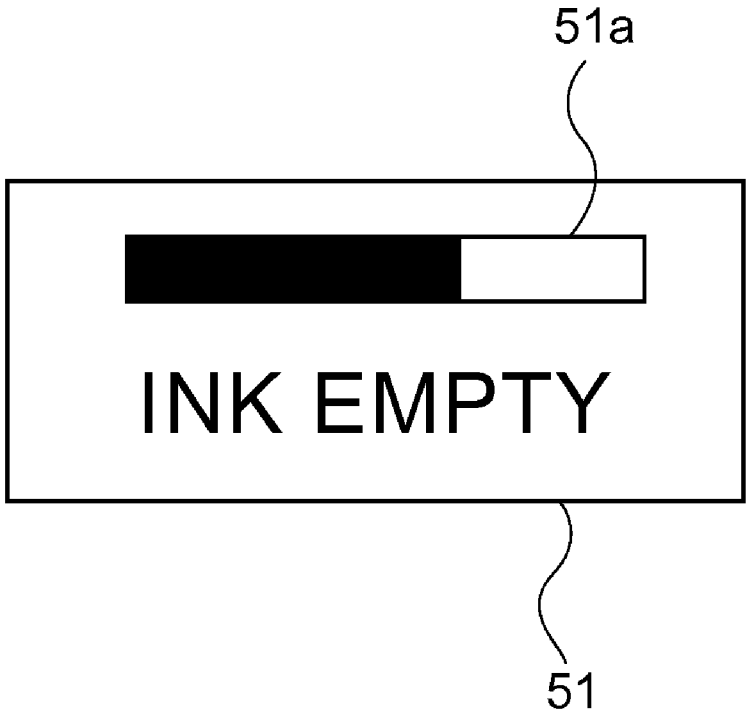
FIG. 5 is a plan view of the printable part of the ink cartridge.

FIG. 1 to FIG. 5 describe an inkjet printer as an example of a fluid discharge device according to a preferred embodiment of the invention. FIG. 1 is an oblique view showing the external appearance of the inkjet printer, FIG. 2 is an oblique view showing the inkjet printer with the printer case removed, FIG. 3 is a block diagram describing the control system of the inkjet printer, FIG. 4 is a flow chart describing the flow of control by the control unit, and FIG. 5 is a plan view of the printable part of the ink cartridge.

The structure of an inkjet printer as a preferred embodiment of a fluid discharge device according to the present invention is described next.

The inkjet printer 1 shown in FIG. 1 is a color printer that prints to recording paper delivered from a paper roll using a plurality of color inks (four inks, black, cyan, magenta, and yellow in this embodiment of the invention). A roll paper cover 5 is disposed to open and close freely at the front of the printer case 2 that covers the printer. A power switch 3, a paper feed switch, and indicators are also disposed on the front of the printer case 2.

As shown in FIG. 2, opening the roll paper cover 5 opens a paper storage unit 13 that holds the roll paper 11, which is the recording paper 12 used as the print medium wound into a roll, so that the roll paper 11 can be loaded or replaced.

Also inside, a substantially rectangular box-like ink cartridge (fluid tank) 17 can be inserted into a cartridge loading unit (loading unit) 15 in the direction of arrow A, and can be removed by moving the ink cartridge 17 in the opposite direction.

A carriage 23 on which the inkjet head (head) 21 is mounted is disposed above the paper storage unit 13 inside the printer case 2. The carriage 23 is supported freely and movably across the width of the paper on a guide member 25 that extends widthwise to the roll paper 11, and can be moved bidirectionally above the platen 28 across the width of the roll paper 11 by an endless belt (not shown in the figure) extending widthwise to the roll paper 11 and a carriage motor 26 that drives the endless belt. The inkjet head 21 discharges ink to print on the recording paper 12 delivered from the paper roll 11.

As shown in FIG. 2, the standby position (home position) of the bidirectionally moving carriage 23 is on the opposite side of the roll paper 11 as the cartridge loading unit 15. A waste ink vacuum mechanism 29 for vacuuming and disposing ink inside the ink nozzles of the inkjet head 21 exposed from the bottom of the carriage 23 is disposed below the standby position.

The ink cartridge 17 stores a plurality of color ink packs (not shown) inside the cartridge case (housing) 18. Each of the ink packs inside the ink cartridge 17 is made of a flexible material and is sealed with ink stored inside. When the ink cartridge 17 is loaded into the cartridge loading unit 15, an ink supply needle (not shown) disposed on the cartridge loading unit 15 side is inserted to connect with the ink supply opening of the ink pack. This ink supply opening is formed on the surface of the ink cartridge 17 on the insertion side when the ink cartridge 17 is inserted in the direction of arrow A. A ink path 31 fixed inside the printer case 2 is connected to the ink supply needle of the cartridge loading unit 15, and one end of a flexible ink supply tube 33 having a channel for each color is connected to the ink path 31.

The other end of the ink supply tube 33 is connected to an ink pump unit 34 disposed on the carriage 23 for each color. Each ink pump unit 34 is disposed above the inkjet head 21, and connected to the self-sealing unit 36 connected to the inkjet head 21.

In addition to the inkjet head 21, the ink pump unit 34 and the self-sealing unit 36 are disposed in unison with the carriage 23.

As a result, ink from each ink pack inside the ink cartridge 17 is supplied to the ink nozzles of the inkjet head 21 from the ink supply needle of the cartridge loading unit 15 through the ink path 31, the ink supply tube 33, the ink pump unit 34 for each color, and the self-sealing unit 36 for each color.

The ink pump unit 34 pulls ink from the ink cartridge 17 by the force generated from movement of carriage 23, and the regulator panel 37 that causes the ink pump unit 34 to operate by the movement force of carriage 23 is disposed to the front in the direction of the movement of carriage 23 to the standby position.

When the rocker arm 35 of the ink pump unit 34 contacts the regulator panel 37 as a result of the carriage 23 moving to the standby position, the rocker arm 35 rocks and drives the internal pump. This causes the pump to pull ink from the ink cartridge 17.

Ink that is vacuumed from the inkjet head 21 by the waste ink vacuum mechanism 29 when the inkjet head 21 is cleaned is returned to the ink cartridge 17 as waste ink and is stored in a waste ink absorber inside the ink cartridge 17.

Because the ink cartridge 17 loaded into the cartridge loading unit 15 of the inkjet printer 1 is substantially box-shaped, a printable part 51 is disposed on a part of the outside top surface 19 of the ink cartridge 17 when the ink cartridge 17 is loaded in the cartridge loading unit 15. This printable part 51 may be a printable label, or it may be made printable by appropriately providing an ink-absorbing layer on the ink cartridge 17.

When the ink cartridge 17 is loaded in the cartridge loading unit 15, the printable part 51 of the ink cartridge 17 is positioned substantially flush with the recording paper 12 on the platen 28, that is, the surface to which the inkjet head 21 prints (discharges fluid).

Note that the carriage 23 can also travel past the printing area of the recording paper 12 to the cartridge loading unit 15 side, and can print on the printable part 51 of the ink cartridge 17 loaded in the cartridge loading unit 15.

A storage unit 52, such as an IC chip substrate, is disposed on the ink cartridge 17 on a side surface away from the location of the printable part 51. An ink usage history including such information as remaining ink quantity, waste ink quantity, first date of use, and device identification information can be written to and read from the storage unit 52. Information about the type of ink, for example, is also stored to the storage unit 52 in addition to the ink usage history.

The inkjet printer 1 also has a reader/writer (reading/writing unit) 61 described below that reads and writes the ink usage history to the storage unit 52 of the ink cartridge 17.

As shown in FIG. 3, the control unit (controller) 60 of the inkjet printer 1 sends control signals to the inkjet head 21 and carriage motor 26 to control the driving of the inkjet head 21 and carriage motor 26 and print to the recording paper 12. The reader/writer 61 that reads and writes the ink usage history in the storage unit 52 is connected to the control unit 60, and the control unit 60 accesses the ink usage history in the storage unit 52 through the reader/writer 61.

Processing the ink usage history by the control unit 60 is described next with reference to the flow chart in FIG. 4.

When printing starts (step S1), the control unit 60 reads the ink information (ink usage history) stored in the storage unit 52 of the ink cartridge 17 loaded in the cartridge loading unit 15 by the reader/writer 61 (step S2). If the loaded ink cartridge 17 is new, the control unit 60 writes the first date of use and device identification information for the device using the ink cartridge 17 to the storage unit 52.

Thereafter at the ink information update timing, which occurs at a predetermined interval or when the inkjet head 21 is cleaned by the waste ink vacuum mechanism 29, for example, (step S3 returns Yes), the control unit 60 determines the remaining ink quantity and waste ink quantity in the ink cartridge 17 based on how much ink has been consumed by the printing process and how much ink was vacuumed from the inkjet head 21 by the waste ink vacuum mechanism 29, and writes the remaining ink quantity and waste ink quantity to the storage unit 52 as ink information (step S4).

At this time the control unit 60 controls the inkjet head 21 and carriage motor 26 to move the inkjet head 21 passed the printing area of the recording paper 12 to a position above the ink cartridge 17, and print the remaining ink quantity information in the ink information written to the storage unit 52 to the printable part 51 of the ink cartridge 17 by the inkjet head 21 (step S5).

As shown in FIG. 5, one method of printing the remaining ink quantity information is to provide a rectangular indication bar graph 51*a* in the printable part 51 and then gradually fill the indication bar graph 51*a* from one end according to the remaining ink quantity, and print a message such as INK EMPTY on the printable part 51 when the remaining ink quantity goes to a zero level.

Note that because the color ink packs for the four colors (black, cyan, magenta, and yellow) that are stored inside the ink cartridge 17 cannot be individually replaced in this embodiment of the invention, the remaining ink quantity printed in FIG. 5 corresponds to which of the four colors (black, cyan, magenta, and yellow) that has the lowest level and the ink cartridge 17 is replaced when any one color is depleted. The remaining ink quantity can also be printed for each color.

When the process printing to the recording paper 12 ends (step S6 returns Yes), the control unit 60 also ends the ink information process.

The inkjet printer and control method for the same described in the foregoing embodiment can both store the ink usage history of the ink cartridge 17 in an storage unit 52 and print the information on a printable part 51 on the outside of the ink cartridge 17 by the inkjet head 21 for printing to recording paper 12. As a result, the user can easily and visually confirm ink information such as how much ink is left from the ink cartridge 17 after the ink cartridge 17 has been removed from the cartridge loading unit 15. In addition, when the ink cartridge 17 is reloaded into the cartridge loading unit 15, the ink information can be acquired by reading the ink information stored in the storage unit 52 using the reader/writer 61.

As a result, even if multiple ink cartridges 17 are mixed together, the remaining ink quantity in each ink cartridge 17 can be visually confirmed without loading each ink cartridge 17 into the cartridge loading unit 15 and reading the ink information from the storage unit 52, and mistakenly switching new and old ink cartridges 17 when replacing the ink cartridge 17 can be eliminated.

In addition, the ink cartridge 17 and internal ink packs do not need to be transparent, and ink deterioration resulting from using transparent materials is prevented.

Furthermore, because the control unit 60 prints the ink information on the ink cartridge 17 synchronized to the ink information update timing, which is the timing when the ink information is written to the storage unit 52, the ink information written in the storage unit 52 and the ink information printed on the outside of the ink cartridge 17 match.

Furthermore, because part of the outside of the ink cartridge 17 loaded in the cartridge loading unit 15 is disposed flush to the surface of the recording paper 12 to which the inkjet head 21 prints, the ink information can be easily printed on the outside of the ink cartridge 17 by the inkjet head 21 by moving the inkjet head 21 from the area for printing to the recording paper 12 to the ink cartridge 17 side.

In addition, because the storage unit 52 is separately disposed from the printable part 51, there is little soiling of the storage unit 52 by printing to the printable part 51, and read/write errors by the reader/writer 61 are reduced.

The invention is not limited to the embodiment described above and can be modified and improved in many ways. For example, the ink cartridge can be shaped as shown in FIG. 6.

Figure 6:
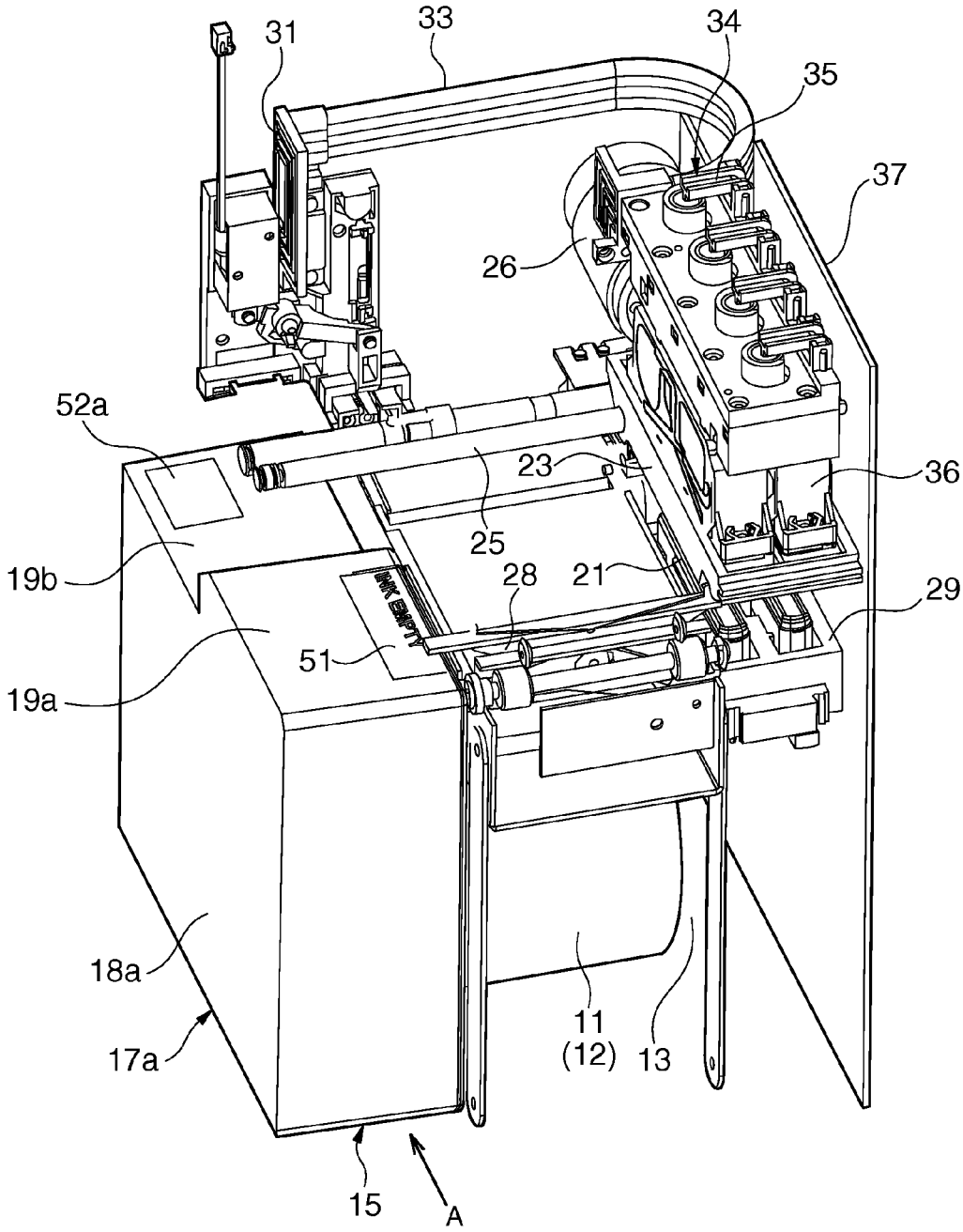
FIG. 6 is an oblique view showing an inkjet printer according to another embodiment of the invention with the printer case removed.

FIG. 6 corresponds to FIG. 2 of the foregoing embodiment, and parts with the same or similar function as described in the preceding embodiment are identified using the same reference numerals below.

The differences between this ink cartridge 17*a* and the ink cartridge 17 described above are that the side where the printable part 51 is disposed is formed as a step projecting above the flat top surface 19*b* with the printable part 51 disposed on the top protruding surface 19*a*, and a storage unit 52*a*, such as an IC chip substrate, is disposed on the top surface 19*b* at a position away from the printable part 51.

This aspect of the invention is described next with reference to FIG. 6.

The ink cartridge 17*a* has a substantially box-like shape with the surface on the printable part 51 side formed like a step. More specifically, the part where the printable part 51 is disposed is the protruding surface 19*a*. Because the printable area is on this protruding surface 19*a*, the information printed in the printable part 51 is easy to read and the information is easy to confirm. In addition, if the ink cartridge 17*a* is placed on the printable part 51, stability is poor and the ink cartridge 17*a* easily tips over because this surface is stepped and not flat, and the ink cartridge 17*a* is therefore unlikely to be placed with the protruding surface 19*a* down. Furthermore, even if the ink cartridge 17*a* is placed on the printable part 51, the stepped shape causes the ink cartridge 17*a* to be tilted and the protruding surface 19*a* will therefore not be flat against the surface upon which the ink cartridge 17*a* is placed. Dust, particulate, and other foreign matter therefore will not stick to the printable part 51 when set down, and the quality of printing to the printable part 51 by the inkjet head 21 will not drop. These effects can be further enhanced by reducing the size of the protruding surface 19*a*. In this embodiment of the invention the protruding surface 19*a* is formed on the side of the rectangular printable part 51 with the smallest area.

Regarding the storage unit 52*a*, even if the ink cartridge 17*a* is placed with the printable part 51 down, the protruding surface 19*a* prevents the top surface 19*b* from touching the surface upon which the cartridge 17*a* is placed. Therefore, the IC chip substrate 52*a* can be protected from dust and other foreign matter on the surface it touches.

The invention is not limited to the embodiments described above and can be further modified in many ways.

For example, waste ink vacuumed by the waste ink vacuum mechanism 29 is held in a waste ink absorber in the ink cartridge 17, but the waste ink storage unit of the ink cartridge 17 can be formed without the ink absorber. In this case there is no need to replace the waste ink absorber when the cartridge is reused, and the cartridge can be reused by simply wiping out the waste ink.

The printable part 51 of the ink cartridge 17, 17*a* is disposed flush with the recording paper 12 on the platen 28, that is, the printing surface (discharge surface) of the inkjet head 21, when loaded in the cartridge loading unit 15, but if the discharge performance of the inkjet head 21 is good, the printable part 51 does not need to be flush with the recording paper 12. Forming them flush, however, enables printing with the same quality as on the roll paper.

If a printable label that can be peeled off without leaving anything on the cartridge is used as the printable part 51, the number of steps required to remove the label when reusing the ink cartridge can be reduced.

Furthermore, the control unit 60 acquires the remaining ink quantity and waste ink quantity in the ink cartridge 17 based on the amount of ink consumed for printing and amount of ink vacuumed from the inkjet head 21 by the waste ink vacuum mechanism 29, but it is only necessary to determine the remaining ink quantity. The waste ink quantity does not need to be used.

In addition to inkjet printers as described above, the fluid discharge device according to the present invention can be applied in fluid discharge devices equipped with fluid discharge heads for discharging a variety of fluids, including color agent discharge heads used in manufacturing color filters for liquid crystal displays, electrode material discharge heads used for forming electrodes in organic EL display and FED (field emission display) devices, and bio-organic material discharge heads used in biochip manufacture. The invention can also be used in a reagent discharge device as a precision pipette. The fluid used is also not limited to ink, and can be any material enabling recording a fluid usage history by discharging the fluid to the outside surface of the fluid tank.

The invention being thus described, it will be apparent that it may be varied in many ways. Such variations are not to be regarded as a departure from the spirit and scope of the invention, and all such modifications as would be apparent to one skilled in the art are intended to be included within the scope of the following claims.

What is claimed is:

1. A fluid discharge device comprising:

a loading unit to which a fluid tank storing a fluid is loaded and unloaded;

a head that discharges fluid supplied from the fluid tank loaded in the loading unit;

a reading/writing unit that reads and writes fluid usage history information relating to the use of fluid in the fluid tank to a storage unit disposed on the fluid tank; and a controller that controls the head to record on an outside surface of the fluid tank at least a part of the fluid usage history information written to the storage unit;

wherein the controller records the fluid usage history information on the fluid tank synchronized to the write timing of the fluid usage history information to the storage unit.

2. The fluid discharge device described in claim 1, wherein:

the outside surface of the fluid tank has disposed thereon a label that can be printed on by the head.

3. The fluid discharge device described in claim 1, wherein:

a part of the outside surface of the housing of the fluid tank loaded in the loading unit is disposed flush with the discharge surface of the medium to which the head discharges fluid.

4. A control method for a fluid discharge device having a loading unit to which a fluid tank storing a fluid is loaded and unloaded;

a head that discharges fluid supplied from the fluid tank loaded in the loading unit;

a reading/writing unit that reads and writes fluid usage history information relating to the use of fluid in the fluid tank to a storage unit disposed to the fluid tank;

the control method comprising a step of:

recording at least a part of the fluid usage history information written to the storage unit on an outside surface of the fluid tank by the head.

5. The control method for a fluid discharge device described in claim 4, wherein:

recording the fluid usage history information on the fluid tank is synchronized to the write timing of the fluid usage history information to the storage unit.

6. A fluid tank having fluid inside, comprising:

a protruding part that protrudes from a part of the fluid tank housing and has a protruding surface that projects above the part of the fluid tank housing; and a printable part that can be printed on, the printable part being disposed on the protruding surface of the protruding part;

wherein fluid usage history information relating to the use of fluid in the fluid tank is recorded on the printable part.

7. The fluid tank described in claim 6, wherein:

the printable part can be printed on using the fluid.

8. The fluid tank described claim 6, further comprising: a storage unit that stores data used for detecting a remaining fluid amount, wherein said storage unit is disposed at a position on the fluid tank housing away from the printable part.

9. The fluid tank described in claim 8, wherein:

the storage unit is disposed on a surface of the part from which the protruding part protrudes.

10. The fluid tank described in claim 6, wherein:

the fluid tank has a substantially rectangular box shape, and the protruding part is disposed on a surface having a smallest area.

11. The fluid discharge device described in claim 1, wherein the part of the fluid usage history information recorded on the fluid tank is a graph that indicates the fluid use information.

12. The fluid discharge device described in claim 11, wherein the graph is a rectangular indication bar graph that is gradually filled according to the fluid use information.

13. The fluid discharge device described in claim 1, wherein a message is printed on the outside surface of the fluid tank housing when the fluid in the fluid tank reaches approximately zero.

14. A fluid tank having fluid inside, comprising:

a printable part disposed on an outside surface of the fluid tank, wherein fluid usage history information relating to use of the fluid in the fluid tank is recorded on the printable part.

15. The fluid tank described in claim 14, wherein the part of the fluid usage history information recorded on the fluid tank is a graph that indicates the fluid use information.

16. The fluid tank described in claim 14, wherein a message is printed on the outside surface of the fluid tank housing when the fluid in the fluid tank reaches approximately zero.

17. The fluid discharge device of claim 2, wherein the fluid usage history information is written to the storage unit and the label at a same timing.

* * * * *